US007069890B2

(12) United States Patent
Fujita et al.

(10) Patent No.: US 7,069,890 B2
(45) Date of Patent: Jul. 4, 2006

(54) VALVE TRAIN DEVICE FOR AN ENGINE

(75) Inventors: Hideo Fujita, Shizuoka-ken (JP); Koichi Hatamura, Hiroshima (JP)

(73) Assignee: Yamaha Motor Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/990,619

(22) Filed: Nov. 17, 2004

(65) Prior Publication Data

US 2005/0229882 A1 Oct. 20, 2005

Related U.S. Application Data

(63) Continuation of application No. PCT/JP03/06236, filed on May 19, 2003.

(51) Int. Cl.
*F01L 1/18* (2006.01)

(52) U.S. Cl. ..... 123/90.39; 123/90.16; 123/90.2; 123/90.44

(58) Field of Classification Search ..... 123/90.16, 123/90.27, 90.31, 90.2, 90.23, 90.24, 90.25, 123/90.26, 90.39, 90.44; 74/559, 567, 569
See application file for complete search history.

(56) References Cited

U.S. PATENT DOCUMENTS

| | | | | |
|---|---|---|---|---|
| 4,572,118 | A | 2/1986 | Baguena | |
| 4,714,057 | A * | 12/1987 | Wichart | 123/90.15 |
| 5,018,487 | A | 5/1991 | Shinkai | |
| 5,189,998 | A | 3/1993 | Hara | |
| 5,373,818 | A * | 12/1994 | Unger | 123/90.16 |
| 6,425,357 | B1 | 7/2002 | Shimizu et al. | |
| 2001/0052329 | A1 | 12/2001 | Himsel | |

FOREIGN PATENT DOCUMENTS

JP 06-017626 1/1994

(Continued)

OTHER PUBLICATIONS

Co-pending U.S. Appl. No. 10/990,557, filed Nov. 17, 2004 by Applicant Hideo Fujita, et al.

(Continued)

*Primary Examiner*—Thomas Denion
*Assistant Examiner*—Ching Chang
(74) *Attorney, Agent, or Firm*—Knobbe, Martens, Olsson & Bear, LLP.

(57) ABSTRACT

A valve train device for an engine is adapted to pivot a rocker arm supported on a rocker arm support shaft to drive a valve which opens and closes a valve opening formed in a combustion chamber. The device comprises a valve drive device and a swing member pivotally supported on a swing member support shaft and driven to pivot about the swing member support shaft by the valve drive device. An intermediate rocker member is pivotally supported on the rocker arm support shaft. The intermediate rocker member is provided between a swing cam surface formed on the swing member and a rocker face formed on the rocker arm, for transmitting the movement of the swing cam surface generated by the valve drive device to the rocker face. An intermediate rocker moving mechanism is configured to rotate the rocker arm support shaft and thereby move a first contact point between the intermediate rocker member and the swing cam surface and a second contact point between the intermediate rocker member and the rocker face to continuously vary at least one of the valve opening duration and the amount of valve lift.

17 Claims, 12 Drawing Sheets

FOREIGN PATENT DOCUMENTS

| | | |
|---|---|---|
| JP | 06-307219 | 1/1994 |
| JP | 06-093816 | 5/1994 |
| JP | 07-133709 | 5/1995 |
| JP | 07-063023 | 7/1995 |
| JP | 07-293216 | 7/1995 |
| JP | 63-309797 | 12/1998 |
| JP | 11-36833 | 2/1999 |
| JP | 11-036833 | 9/1999 |
| JP | 2003-106123 A | 4/2003 |
| JP | 2003-239713 | 8/2003 |
| JP | 2003-106123 | 9/2003 |

OTHER PUBLICATIONS

Co-pending U.S. Appl. No. 11,263,528, filed on Oct. 31, 2005 by Hideo Fujita.

Co-pending U.S. Appl. No. 11,263,573, filed on Oct. 31, 2005 by Hideo Fujita.

* cited by examiner

VALVE TRAIN DEVICE FOR AN ENGINE

PRIORITY INFORMATION

The present application is a continuation of PCT Application No. PCT/JP03/06236, filed on May 19, 2003, which claims priority under 35 U.S.C. § 119 to Japanese Patent Application No. 2002-143036, filed on May 17, 2002, and the entire contents of both of which are expressly incorporated by reference herein.

BACKGROUND OF THE INVENTION

1. Field of the Invention

The present invention relates to a valve train device for an engine capable of continuously controlling valve opening duration and the amount of valve lift.

2. Description of the Related Art

A valve train device for an engine capable of continuously controlling valve opening duration and the amount of valve lift has been practically used. Such conventional valve train device is disclosed in JP-A-Sho 59-500002, for example. This valve train device is configured to cause a camshaft to drive an intake valve to open and close through a rocker arm, in a way such that a swing member driven to swing by the camshaft is provided, and an intermediate rocker roller is interposed between a swing cam surface of the swing member and the rocker arm. Changing the position of the intermediate rocker roller causes the valve opening duration and the amount of valve lift to continuously change.

Meanwhile, when the configuration of changing the position of the intermediate rocker roller is used as in the conventional valve train device, the overall structure of the device becomes complex depending on the structure of a mechanism for of the valve characteristics is not obtained.

SUMMARY OF THE INVENTION

An object of the present invention is to provide a valve train device for an engine with a simple structure capable of continuously changing valve opening duration and the amount of valve lift.

Therefore, one embodiment of the present invention comprises a valve train device for an engine that is adapted to pivot a rocker arm supported on a rocker arm support shaft to drive a valve which opens and closes a valve opening formed in a combustion chamber. The device comprises a valve drive device and a swing member pivotally supported on a swing member support shaft and driven to pivot about the swing member support shaft by the valve drive device. An intermediate rocker member is pivotally supported on the rocker arm support shaft. The intermediate rocker member is provided between a swing cam surface formed on the swing member and a rocker face formed on the rocker arm, for transmitting the movement of the swing cam surface generated by the valve drive device to the rocker face. An intermediate rocker moving mechanism is configured to rotate the rocker arm support shaft and thereby move a first contact point between the intermediate rocker member and the swing cam surface and a second contact point between the intermediate rocker member and the rocker face to continuously vary at least one of the valve opening duration and the amount of valve lift.

Another embodiment of the invention comprises a method of continuously adjusting at least one of maximum valve lift and valve timing of a valve of an internal combustion engine. The method comprising rotating a valve drive device. The rotational movement of the valve drive device is transferred to a swing member that is pivotally supported on a swing member support shaft. The pivoting movement of the swing member is transferred through a first contact point to an intermediate member that is pivotally supported on a rocker arm support shaft. The pivoting movement of the intermediate member is transferred through a second contact point to a rocker arm that is pivotally supported on the rocker arm support shaft and is configured to cause the valve to open and close. The orientation of the first and second contact points are changed with respect to the rocker shaft so as to change at least one of the valve duration and the maximum valve lift.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements various features of specific embodiments of the invention will now be described with reference to the drawing. The drawing and the associated descriptions are provided to illustrate embodiments of the invention and not to limit the scope of the invention.

DETAILED DESCRIPTION OF THE PREFERRED EMBODIMENT

An embodiment of the present invention will be described below with reference to the accompanying drawings.

Figure 1:
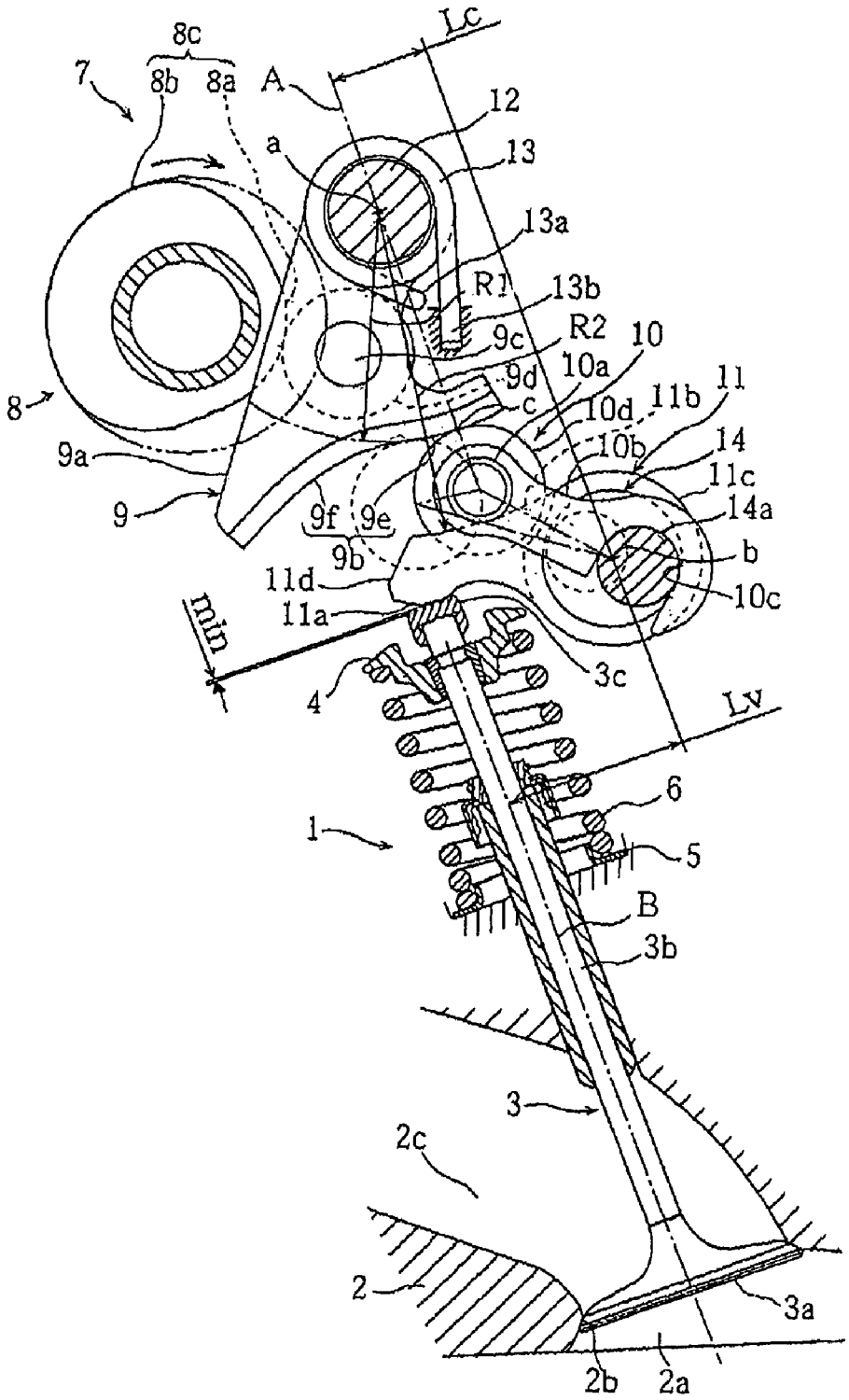
FIG. 1 is a sectional side view of a valve train device for an engine in a first position according to a first embodiment of the present invention.
Figure 2:
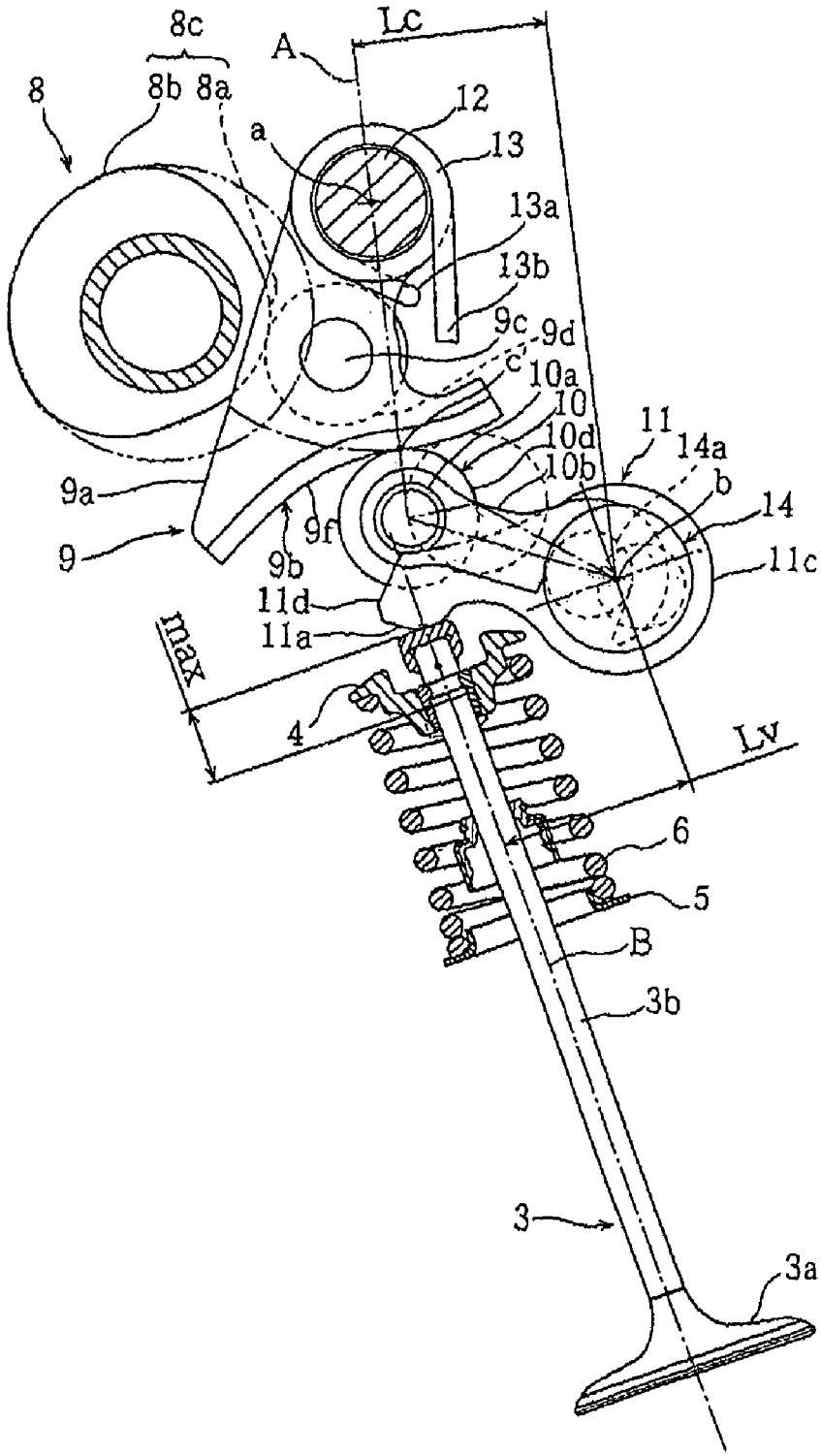
FIG. 2 is a sectional side view of the device of the above first embodiment in a second position.
Figure 3:
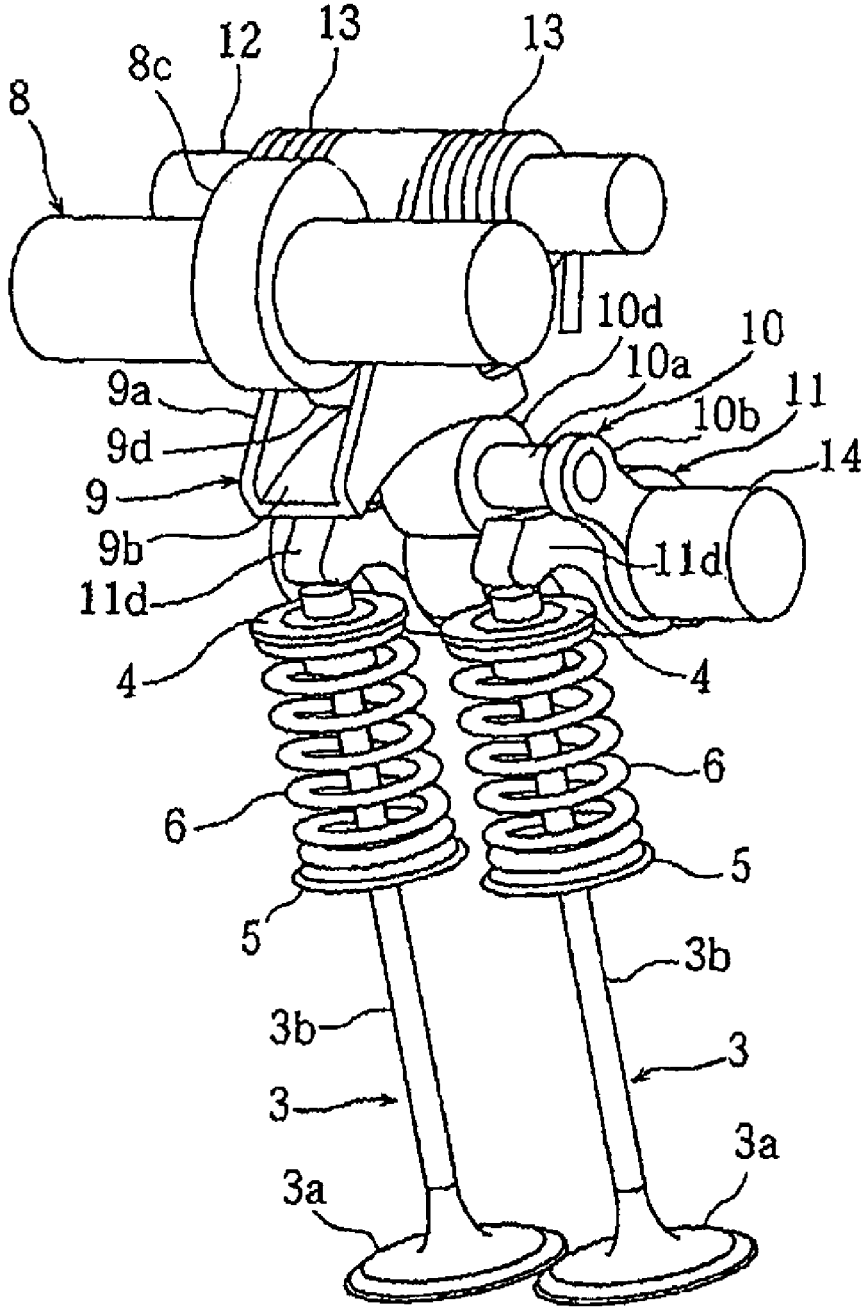
FIG. 3 is a front perspective view of the device of the above first embodiment.
Figure 4:
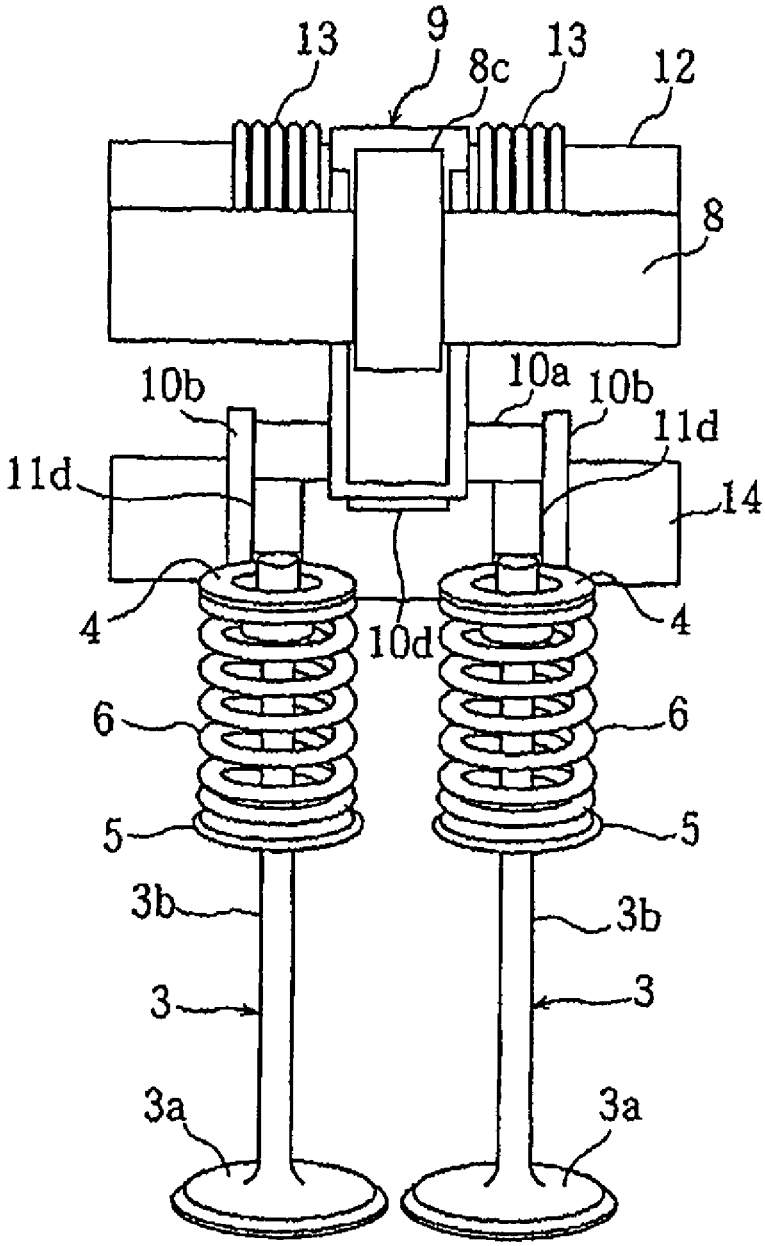
FIG. 4 is a front view of the device of the above first embodiment.
Figure 5:
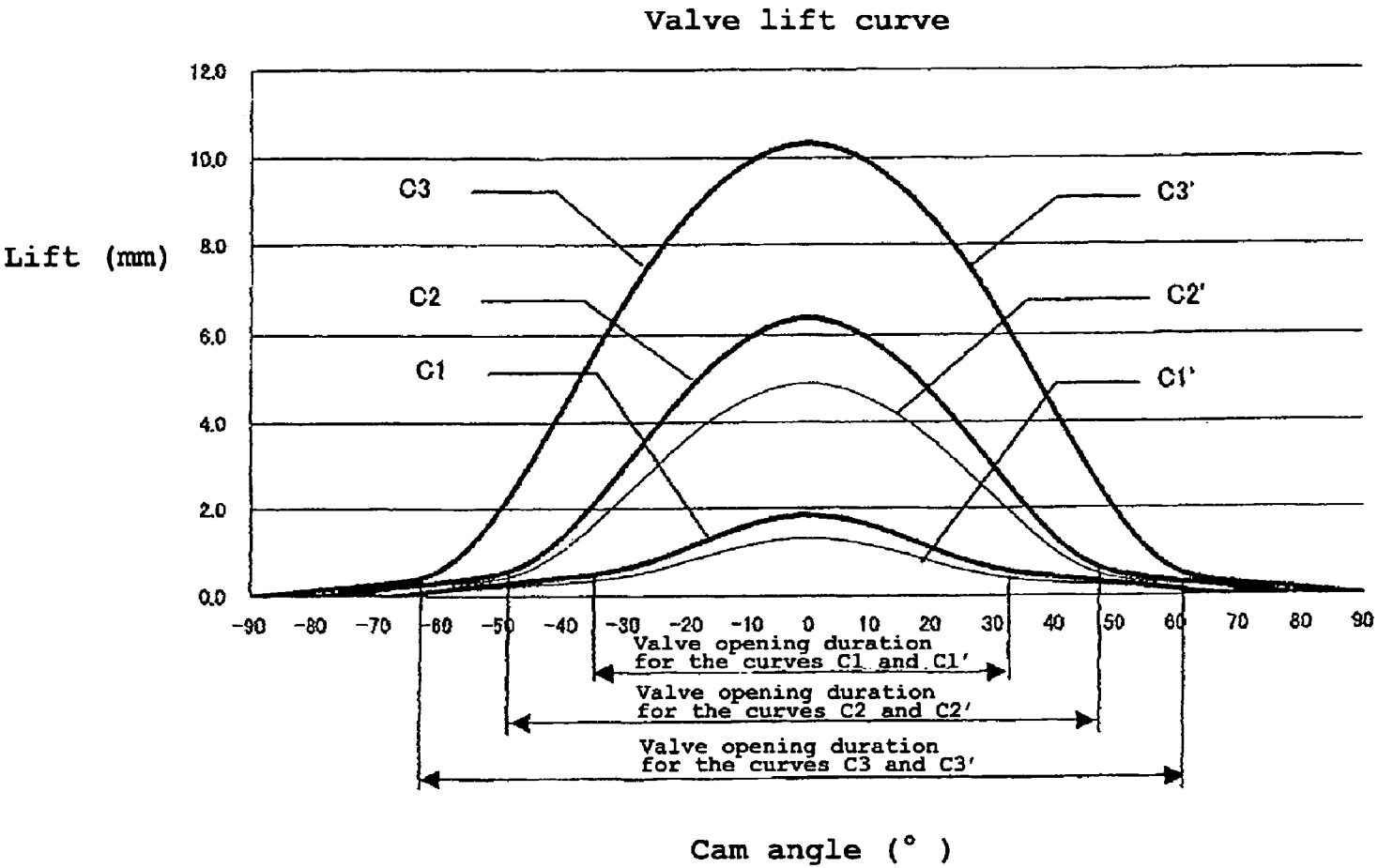
FIG. 5 is a cam angles versus lift characteristics graph of the device of the above first embodiment.

FIGS. 1 through 5 are explanatory drawings of a first embodiment of the present invention. FIGS. 1 and 2 are sectional side views, showing an intake valve of a valve train device for an engine according to this embodiment in a small opening state and in a large opening state, respectively. FIGS. 3 and 4 are a front perspective view and a front view of the valve train device, respectively, and FIG. 5 is a cam angles versus lift characteristics graph for explaining operation of the device.

In FIG. 1, reference numeral 1 denotes a valve device for opening and closing valve openings formed in a combustion chamber, in which only a portion at the intake valve side is shown. A cylinder head 2 has a combustion recess 2*a* formed to configure a portion of the combustion chamber of the engine at the ceiling wall side. The combustion recess 2*a* is formed with left and right intake valve openings 2*b*. Each intake valve opening 2*b* is connected to an intake port 2*c* and leads to an opening formed on an engine wall and connected to the outside. Each intake valve opening 2*b* is opened and closed through a valve head 3*a* of an intake valve 3. The intake valve 3 is constantly urged in a closed direction by a valve spring 6, which is interposed between a retainer 4 mounted on the upper end of a valve stem 3*b* of the intake valve 3 not to be axially movable and a spring seat 5 placed on the surface of the cylinder head 2.

In the embodiments described below, reference will be made to the intake valve. However, it should be appreciated that certain features and aspects of these embodiments may also be applied to an exhaust valve. It should also be appreciated that various features, aspects and advantages of the present invent may be used with engines having more than one intake valve and/or exhaust valve, and any of a variety of configurations including a variety of numbers of cylinders and cylinder arrangements (V, W, opposing, etc.

A valve train device 7 is provided above the intake valve 3 and configured such that: an intake camshaft 8 which serves as swing member driving means causes a swing member 9 to swing, the swing member 9 causes a rocker arm 11 to swing through a intermediate rocker 10, and the swing of the rocker arm 11 causes the intake valve 3 to proceed and retract in the axial direction, and thus the intake valve opening 2*b* is opened and closed.

The intake camshaft 8 may be arranged in parallel with a crankshaft (not shown). The intake camshaft 8 is supported to be rotatable and not to be movable in a direction perpendicular to the crankshaft or in the axial direction through a cam journal portion formed on the cylinder head 2 and a cam cap provided on an upper mating face of the journal portion. The intake camshaft 8 is formed with a single cam nose 8*c* common to left and right intake valves, including a base circle portion 8*a* having a specified diameter and a lift portion 8*b* having a specified cam profile.

The swing member 9 has a pair of swing arm portions 9*a*, 9*a*, a swing cam surface 9*b*, a roller shaft 9*c*, and a swing roller 9*d*. The pair of swing arm portions 9*a*, 9*a* is supported for free swinging movement by a swing shaft 12 arranged in parallel with the intake camshaft 8 so as not to be movable in the direction perpendicular to the swing shaft or in the axial direction. The swing cam surface 9*b* is formed to connect front (lower) ends of the swing arm portions 9*a*. The roller shaft 9*c* is arranged in parallel with the swing shaft 12 and in the midsection between the left and right swing arm portions 9*a*, 9*a* to pass therethrough. The swing roller 9*d* is rotatably supported on the roller shaft 9*c*. The swing roller 9*d* is constantly in rotational contact with the cam nose 8*c*.

The swing shaft 12 is inserted through the base (upper ends) of the swing arm portions 9*a* for free swinging movement. The swing shaft 12 is provided with a pair of left and right balance springs 13 as coil springs. Each balance spring 13 has a first end 13*a* retained by an edge, opposite the camshaft, of the swing arm portion 9*a* between the swing shaft 12 and the roller shaft 9*c*. A second end 13*b* of each balance spring is retained by the cylinder head 2. The balance spring 13 urges the swing member 9 so that the swing roller 9*d* of the swing member 9 is in contact with the cam nose 8*c* of the intake camshaft 8, thereby preventing the weight of the swing member 9 from working on the valve spring 6.

The swing cam surface 9*b* has a base circle portion 9*e* and a lift portion 9*f* formed together in a curved manner to have a connected surface and a generally a plate-like shape. The swing member 9 is provided so that the base circle portion 9*e* is positioned nearer to a rocker shaft 14 and the lift portion 9*f* is positioned opposite the rocker shaft 14. The base circle portion 9*e* has an arcuate shape of a radius R1 centered on the axis of the swing shaft 12 as the center of swing (a). Thus, while the base circle portion 9*e* depresses the swing roller 9*d*, the intake valve 3 is placed at a fully closed position and is not lifted even if the swing member 9 increases in swing angle.

Meanwhile, the lift portion 9*f* lifts the intake valve 3 greatly as the lift portion 8*b* of the intake camshaft 8 at the portion close to the top depresses the swing roller 9*d*, that is, as the swing member 9 increases in swing angle. In this embodiment, the lift portion 9*f* includes a ramp zone which gives a constant speed, an acceleration zone which gives a varied speed, and a lift zone which gives generally a constant speed.

The rocker arm 11 is an integral component of a cylindrical base 11*c*, and left and right arm portions 11*d* extend forward (toward the intake valves) from the base 11*c*. The base 11*c* is supported for free swinging movement by the rocker shaft 14 arranged in parallel with the intake camshaft 8 and close to the axis of a cylinder. Each arm portion 11*d* at the lower front end has a valve depressing surface 11*a* formed to depress a shim 3*c* provided on the upper end of the valve stem 3*b* of the intake valve 3. The upper edge of each arm portion 1*d* is formed with a pressurized rocker face 11*b*, which is depressed by a rocker pin 10*a* of an intermediate rocker 10. The pressurized rocker face 11*b* is formed in an arcuate shape with a radius R2 centered on the center of swing (a) of the swing member 9 as seen in the direction of the camshaft when the valve is in a fully open state.

The rocker shaft 14 can be controlled in rotational angle position by a driving mechanism (not shown). The rocker shaft 14 in the midsection has an eccentric pin portion 14*a* formed to have smaller diameter than other portions and to be decentered radially outward from the center of the axis (b) of the rocker shaft 14. The eccentric pin portion 14*a* is received for free rotational movement in a retaining recess 10*c* formed on an intermediate arm portion 10*b* of the intermediate rocker 10, at the rear end.

The intermediate rocker 10 has a general configuration such that paired left and right intermediate arm portions 10*b* at the front ends are connected together by a rocker pin 10*a* extending in the direction of the camshaft, and fixed thereto, and a rocker roller 10*d* is rotatably supported on the rocker pin 10*a*. Incidentally, the front ends of the intermediate arm portions 10*b* may be connected together in engagement with the rocker pin 10*a*. The rocker roller 10*d* is in rotational contact with the lower surface of the swing cam surface 9*b* of the swing member 9, and the rocker pin 10*a* is in sliding contact with the upper surface of the pressurized rocker face 11*b* of the rocker arm 11.

An intermediate rocker moving mechanism is thus configured such that when the driving mechanism described above changes the rotational angle position of the rocker shaft 14, the intermediate rocker roller 10*d* and the intermediate rocker pin 10*a* of the intermediate rocker 10 move along the swing cam surface 9*b* and the pressurized rocker face 11*b*, respectively.

Here, when it is assumed that the distance from the straight line (A), which connects the center of swing (a) of the swing member 9, the contact point (c) of the swing cam surface 9*b*, and the intermediate rocker roller 10*d*, to the center of swing (b) of the rocker arm 11, is Lc, and the distance from the valve axis (B) to the center of swing (b) of the rocker arm 11 is Lv, a rocker lever ratio is determined by Lv/Lc, in which the amount of valve lift increases for greater lever ratio when the cam nose is positioned at the same height.

When the driving mechanism changes the rotational angle position of the rocker shaft 14, the intermediate rocker roller 10*d* and the intermediate rocker pin 10*a* of the intermediate rocker 10 move along the swing cam surface 9*b* and the pressurized rocker face 11*b*, respectively. Thus, the valve opening and the amount of valve lift continuously change. Incidentally, the driving mechanism controls the rotational angle position of the rocker shaft 14 in accordance with an accelerator pedal opening, for example, so that the valve opening and the amount of valve lift increase for a larger accelerator pedal opening. More specifically, in a small opening state in which the valve opening duration is minimum and the amount of lift is minimum, as shown in FIG. 1, for example, the rocker shaft 14 is rotationally driven so that the eccentric pin portion 14*a* is positioned farthest away from the swing cam surface 9*b*. Thus, the contact point (c) of the rocker roller 10*d* with the swing cam surface 9*b* is positioned farthest away from the lift portion 9*f*. Since the contact point (c) is positioned nearest to the center of swing (b) of the rocker arm 11, Lc becomes minimum, and the rocker lever ratio (Lv/Lc) becomes maximum. The lift curve thus becomes the curve C1 of FIG. 5.

On the other hand, in a large opening state in which the valve opening duration is maximum and the maximum amount of lift is maximum, as shown in FIG. 2, the rocker shaft 14 is rotationally driven so that the eccentric pin portion 14*a* is positioned nearest to the swing cam surface 9*b*. Thus, the contact point (c") of the intermediate rocker roller 10*d* with the swing cam surface 9*b* is positioned nearest to the lift portion 9*f*, and more specifically, in the vicinity of the boundary of the lift portion 9*f* and the base circle portion 9*e*. The rocker lever ratio (Lv/Lc) becomes minimum, since the contact point (c") is positioned away from the center of swing (b) of the rocker arm 11 and Lc becomes maximum. The lift curve thus becomes curve C3 of FIG. 5. The lift curve continuously changes from curve C1 to curve C3 of FIG. 5 as the valve changes from the small opening state to the large opening state.

Curves C1' to C3' of FIG. 5 show lift curves in a comparative example when the rocker lever ratio is constant. More specifically, the device of the comparative example is set to have the same lift curve characteristics in the large opening state as does the device of the present invention. A comparison is made with the change in the amount of lift when the valve changes from the large opening state to the small opening state. As is clear from FIG. 5, in the case of the device of the comparative example with the constant rocker lever ratio, a drop in the amount of lift is greater than in this embodiment in which the rocker lever ratio increases for a smaller opening state, when the comparison is made at the same valve opening.

Incidentally, in the lift curve of FIG. 5, the outside portion of the valve opening duration indicates the ramp zone which has a lift height corresponding to valve clearance. At the ramp zone, the valve does not open in a cold state due to valve clearance, while the valve slightly opens nearly at the end of the ramp zone in a hot operating state due to thermal expansion of the valve stem.

In this embodiment of the valve train device, the swing member 9 swings in connection with the rotation of the camshaft 8. The swing cam surface 9*b* of the swing member 9 depresses the intermediate rocker roller 10*d* in connection with the swing of the swing member 9 to cause the intermediate rocker member 10 to swing. The intermediate rocker pin 10*a* of the intermediate rocker member 10 drives the rocker arm 11 to swing. The rocker arm 11 drives the intake valve 3 to open and close.

When the rocker shaft 14 is rotationally moved, the contact point (c) of the intermediate rocker roller 10*d* of the intermediate rocker member 10 with the swing cam surface 9*b*, and the contact point of the intermediate rocker pin 10*a* of the intermediate rocker member 10 with the pressurized rocker face 11*b*, continuously move, so that the valve opening duration and the maximum amount of valve lift can be continuously controlled.

Further, in this embodiment, there is no change in phase of the valve lift curve between at the large opening state and at the small opening state, providing high versatility. More specifically, a common mechanism and a common component can be used for left and right banks of a V-engine, for example.

The rotational movement of the rocker shaft 14 is used to move the intermediate rocker member 10. This provides a very simple structure and results in an increase in controlled accuracy of the valve opening duration and the maximum amount of lift.

To move the contact point (c) using the rotational movement of the rocker shaft 14, a configuration is used in which the rear end of the intermediate rocker member 10 is swingably connected to the eccentric pin portion 14*a* that is formed in the midsection of the rocker shaft 14. Therefore, when the rocker shaft 14 is rotationally moved, the intermediate rocker roller 10*d* and the intermediate rocker pin 10*a* continuously move along the swing cam surface 9*b* and the pressurized rocker face 11*b*, respectively, so that the valve opening duration and the amount of lift can continuously change with a very simple structure.

Further, the rocker shaft 14 as the center of swing of the rocker arm 11, and the eccentric pin portion 14*a* as the center of swing of the intermediate rocker member 10 are positioned adjacent to each other. This can significantly reduce the sliding amount of the intermediate rocker pin 10*a* of the intermediate rocker member 10 on the pressurized rocker face 11*b* of the rocker arm 11 in connection with the opening and closing of the valve.

Further, in a large opening operating condition, in which the valve opening duration is long and the maximum amount of valve lift is large, the intermediate rocker roller 10*d* and the intermediate rocker pin 10*a* of the intermediate rocker member 10 are moved opposite the rocker shaft, as shown in FIG. 2. Thus, the rocker lever ratio (=Lv/Lc) decreases and the intake valve 3 is depressed generally at the immediate top. The bending moment which works on the rocker arm 11, therefore, decreases, resulting in an increase in rigidity of an overall valve open/close mechanism.

Meanwhile, in a small opening operating condition, in which the valve opening duration is short and the maximum amount of valve lift is small, the intermediate rocker roller 10*d* and the intermediate rocker pin 10*a* are moved toward the rocker shaft 14, as shown in FIG. 1. Thus, the rocker lever ratio (=Lv/Lc) increases, and the maximum amount of valve lift is easily obtained despite the short valve opening duration (see curves C1 and C1' of FIG. 5). This can effect reduction of pumping loss as well as improvement of combustion, prevent reduction in ramp speed, as indicated in the valve lift curve, and improve controllability of valve open/close timing.

Further, the swing roller 9*d* to be depressed by the camshaft is provided in the space enclosed by straight lines which connect the center of swing (a) of the swing member 9 and the ends of the swing cam surface 9*b*, and the swing cam surface 9*b*, as seen in the direction of the camshaft. This can decrease the bending moment produced by the rotational force of the camshaft 8 on a support portion of the swing roller 9*d*, compared to when the swing roller is supported at an end of a separate arm, for example, as in the foregoing prior art, resulting in an increase of rigidity of the swing member.

Furthermore, the balance spring 13 is provided for rotatably urging the swing member 9 in a direction that restricts the weight of the swing member 9 from working on the valve spring 6, which urges the valve in a closed state. Therefore, disposing the swing member 9 does not increase load on the valve spring 6. Thus, there is no need to increase the spring load of the valve spring 6, thereby providing optimum follow-up characteristics of the valve at high engine speed.

Figure 6:
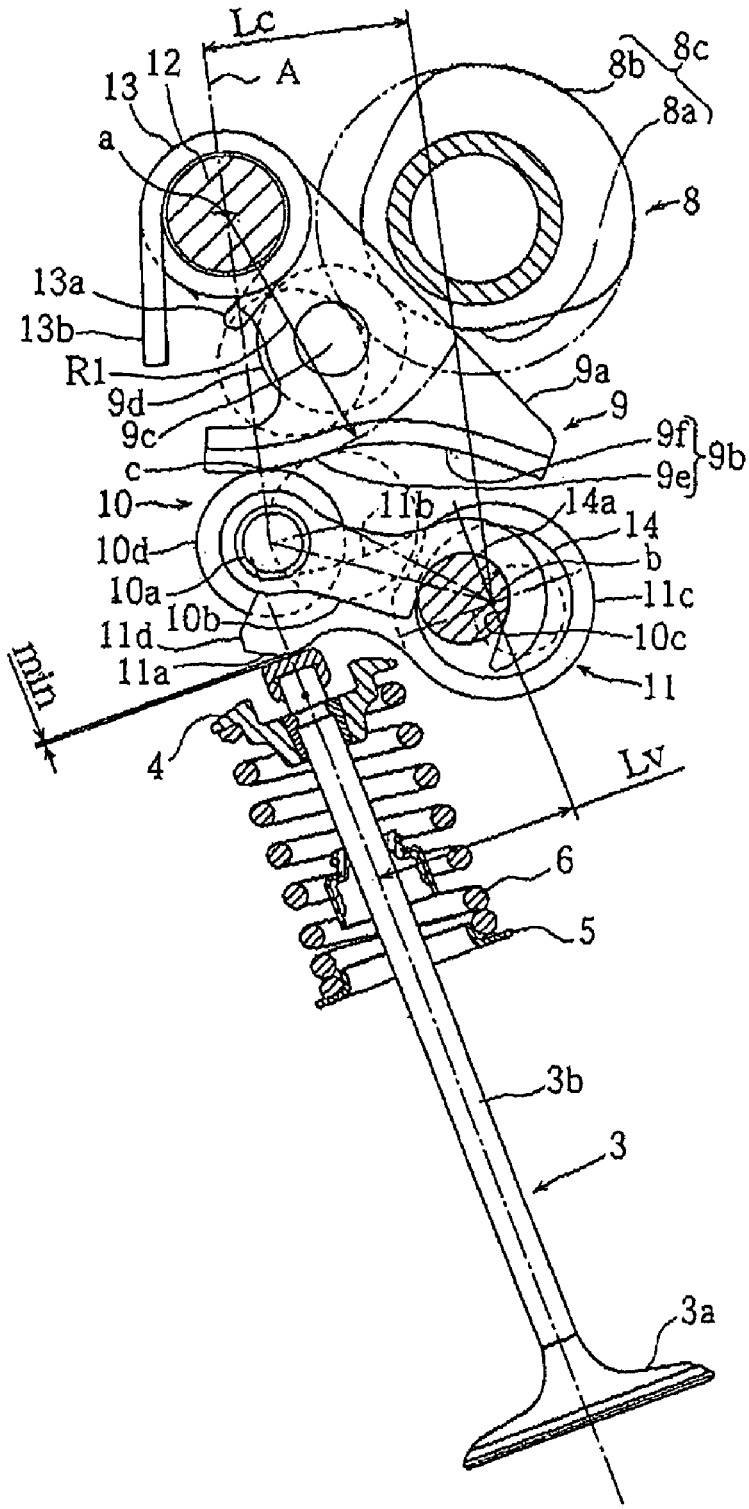
FIG. 6 is a sectional side view of a device according to a second embodiment of the present invention in a first position.
Figure 7:
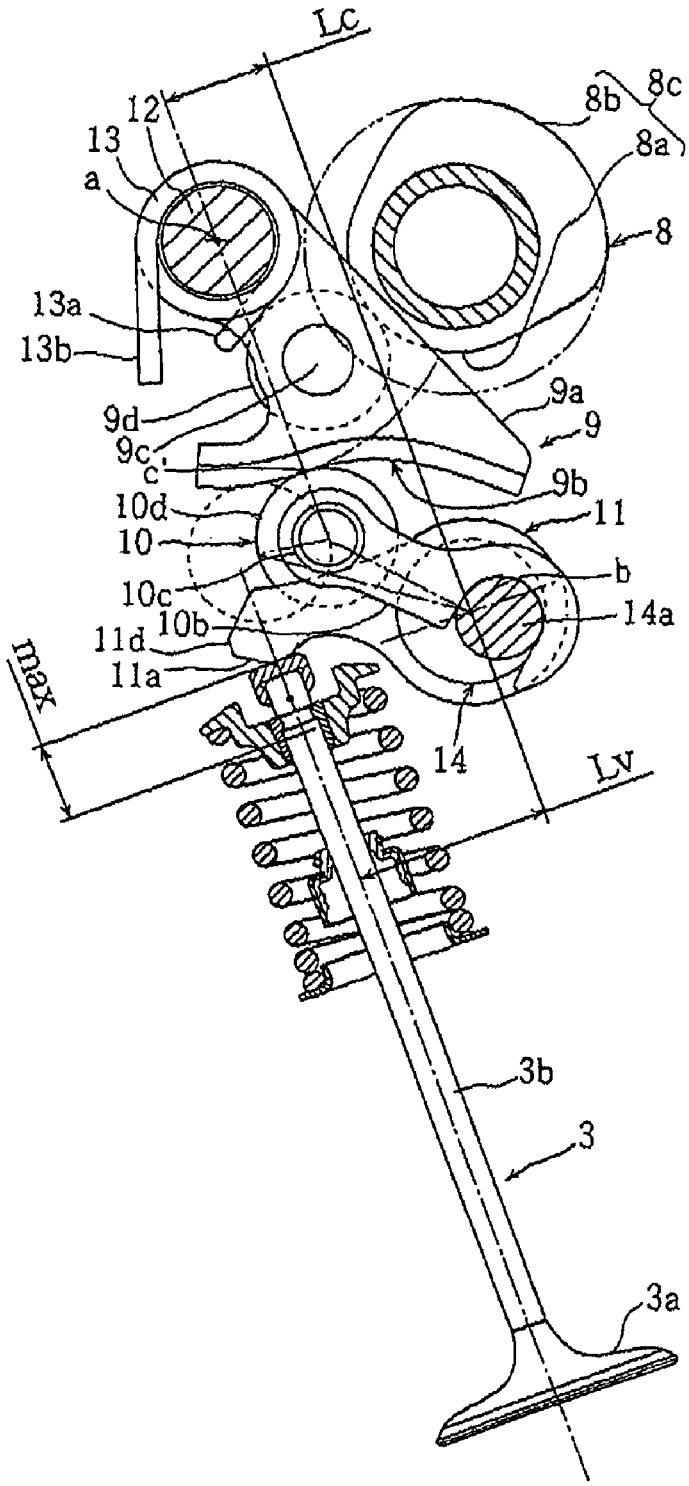
FIG. 7 is a sectional side view of the device of the above second embodiment in a second position.

FIGS. 6 and 7 are explanatory drawings of a second embodiment of the valve train device, in which similar parts are denoted by the same reference numerals as in FIGS. 1 and 2. In the second embodiment, the camshaft 8 and the swing member 9 are arranged in symmetrical relation to the foregoing first embodiment with respect to the straight line (A).

More specifically, the camshaft 8 is arranged on the same side as the rocker shaft 14 of the rocker arm 11 with respect to the swing member 9. The swing member 9 is arranged such that the lift portion 9*f* is positioned on the rocker shaft 14 side. The intermediate rocker roller 10 and the intermediate rocker pin 10*a* are moved opposite the rocker shaft 14, as shown in FIG. 6. Thus, the opening duration of the intake valve 3 and the maximum amount of valve lift decrease, and the rocker lever ratio also decreases.

Also, as the intermediate rocker roller 10 and the intermediate rocker pin 10*a* are moved toward the rocker shaft 14, as shown in FIG. 7, the valve opening duration and the maximum amount of valve lift increase, and the rocker lever ratio also increases.

In such a manner as described, in the second embodiment, in a small opening operating condition, in which the valve opening duration is short and the maximum amount of valve lift is small, the intermediate rocker roller 10*d* and the intermediate rocker pin 10*a* of the intermediate rocker member 10 are moved opposite the rocker shaft (see FIG. 6). Thus, the rocker lever ratio (=Lv/Lc) decreases, and the valve is depressed generally at the immediate top, and the rigidity of the overall valve open/close mechanism increases.

Meanwhile, in a large opening operating condition, in which the valve opening duration is long and the maximum amount of valve lift is large, the intermediate rocker roller 10*d* and the intermediate rocker pin 10*a* are moved toward the rocker shaft 14 (see FIG. 7). Thus, the rocker lever ratio (=Lv/Lc) increases, and the optimum amount of lift is easily obtained.

Figure 8:
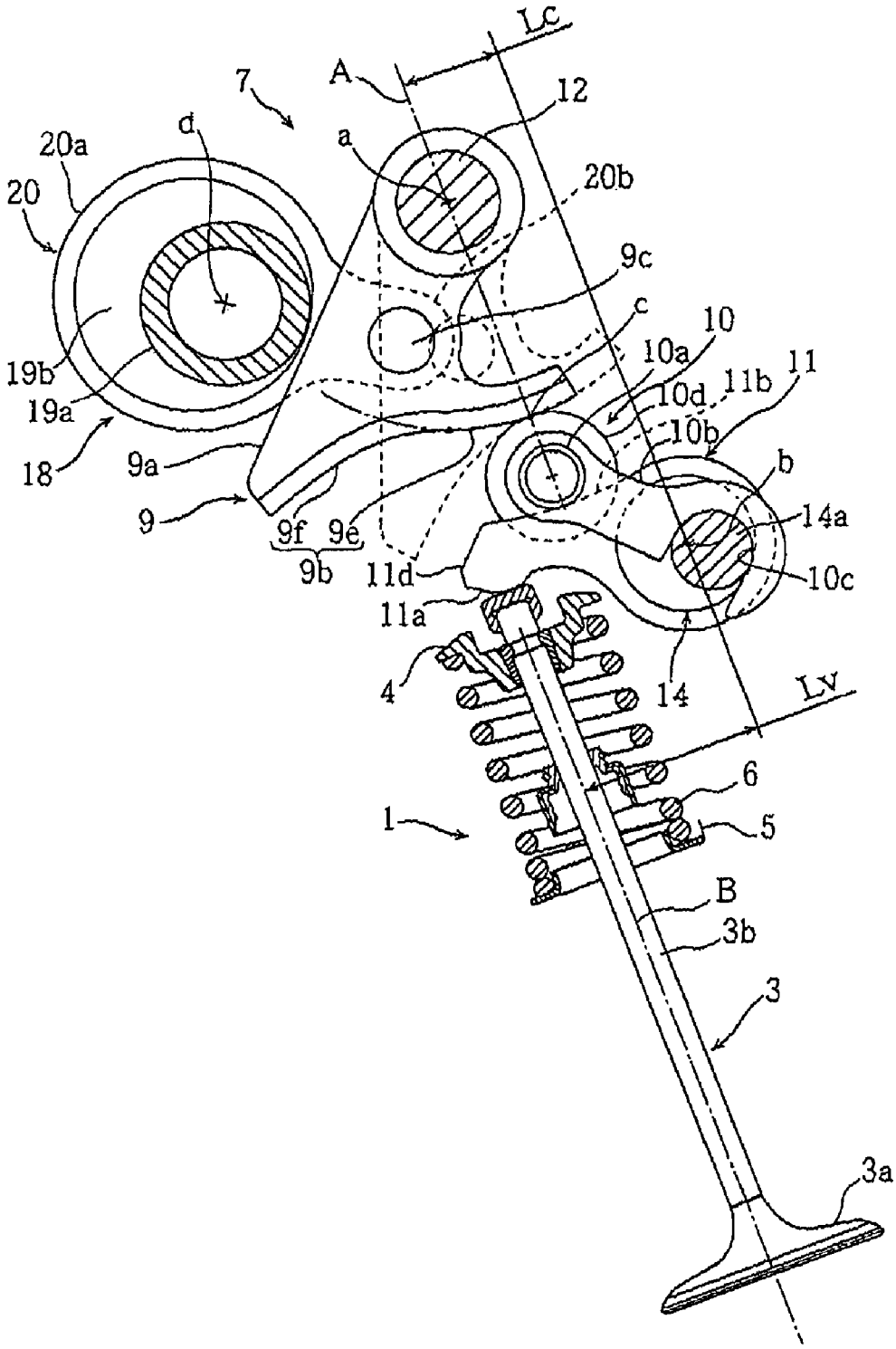
FIG. 8 is a sectional side view of a device according to a third embodiment of the present invention in a first position.
Figure 9:
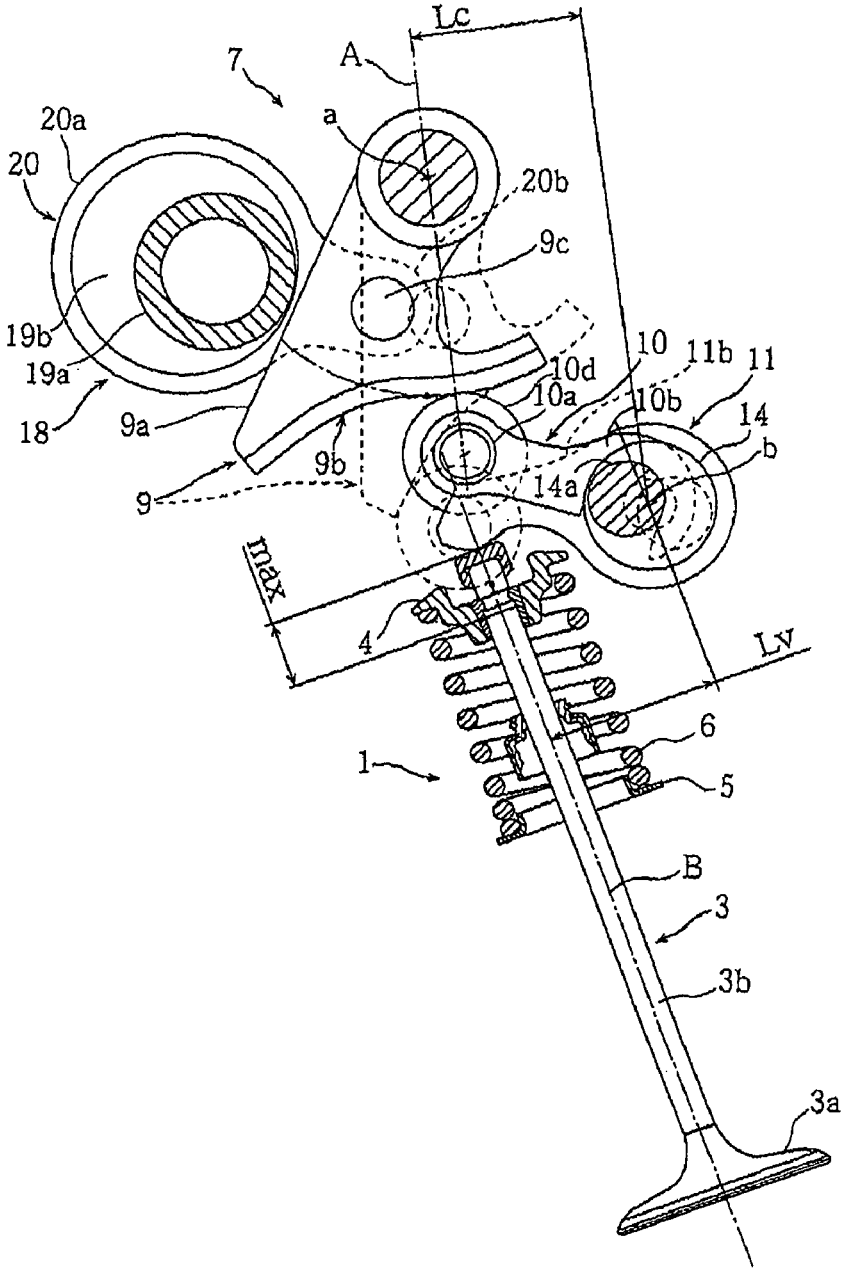
FIG. 9 is a sectional side view of the device of the above third embodiment in a second position.

FIGS. 8 and 9 are explanatory drawings of a third embodiment of the present invention, in which similar parts are denoted by the same reference numerals as in FIGS. 1 and 2.

The third embodiment is an example in which the camshaft is of a crankshaft type. More specifically, a crankshaft (camshaft) 18 is an integral component of a drive shaft 19*a* and a disk-like cam plate 19*b* disposed in the midsection of the drive shaft 19*a* to be decentered therefrom. The cam plate 19*b* is provided with a base end 20*a* of a plate-like connecting rod 20. The other end 20*b* of the connecting rod 20 is rotatably connected to the roller shaft 9*c* of the swing member 9.

In the third embodiment, when the drive shaft 19*a* is rotationally driven, the cam plate 19*b* is rotated centered on the center of the axis (d) of the drive shaft 19*a*. This causes the connecting rod 20 to swing the swing member 9. The swinging movement of the swing member causes the rocker arm 11 to drive the intake valve 3 to open and close through the intermediate rocker member 10.

In the third embodiment, since the camshaft is of a crankshaft type, the swing member 9 is allowed to swing easily and reliably and provides good follow-up characteristics. The valve opening duration and the amount of lift can be controlled with good accuracy. In addition, no balance spring is required.

Figure 10:
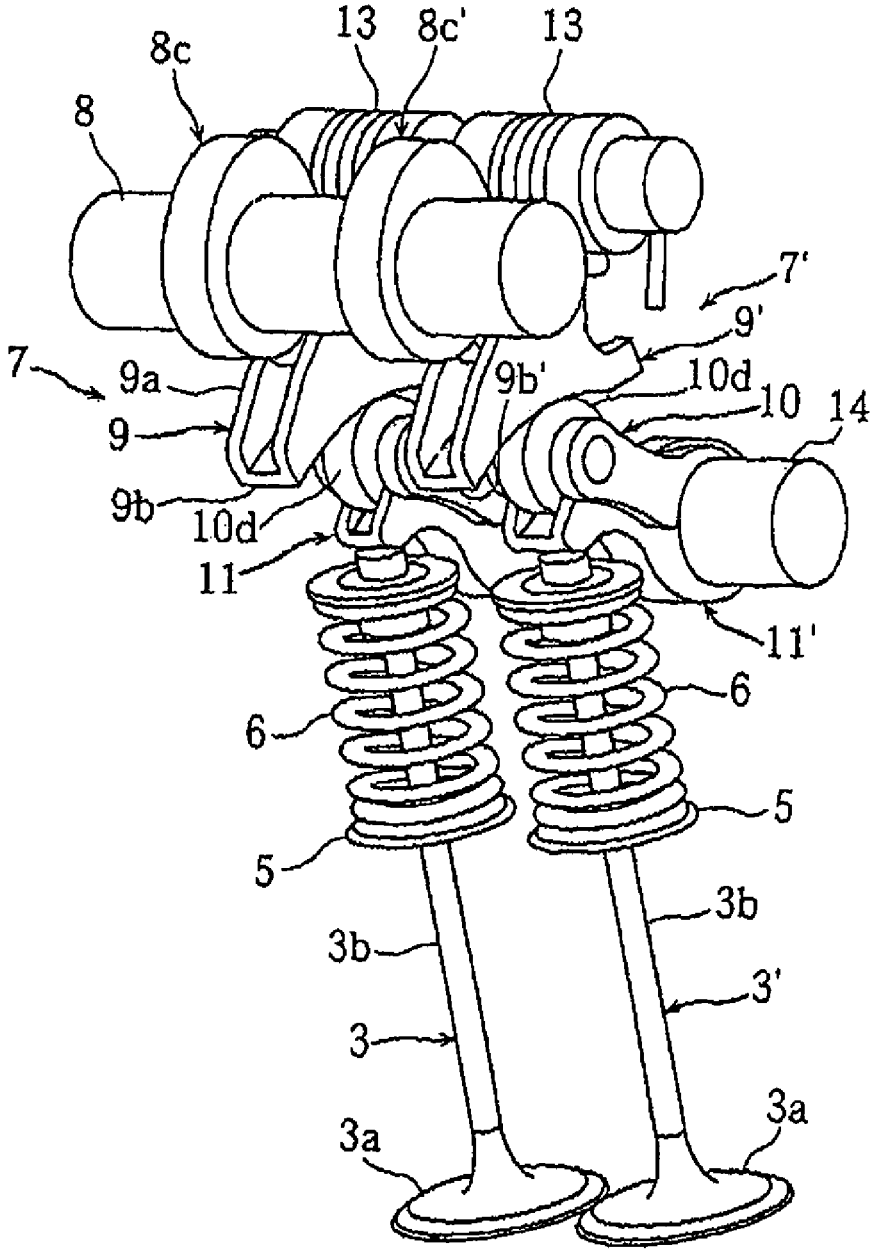
FIG. 10 is a front perspective view of a device according to a fourth embodiment of the present invention in a first position.
Figure 11:
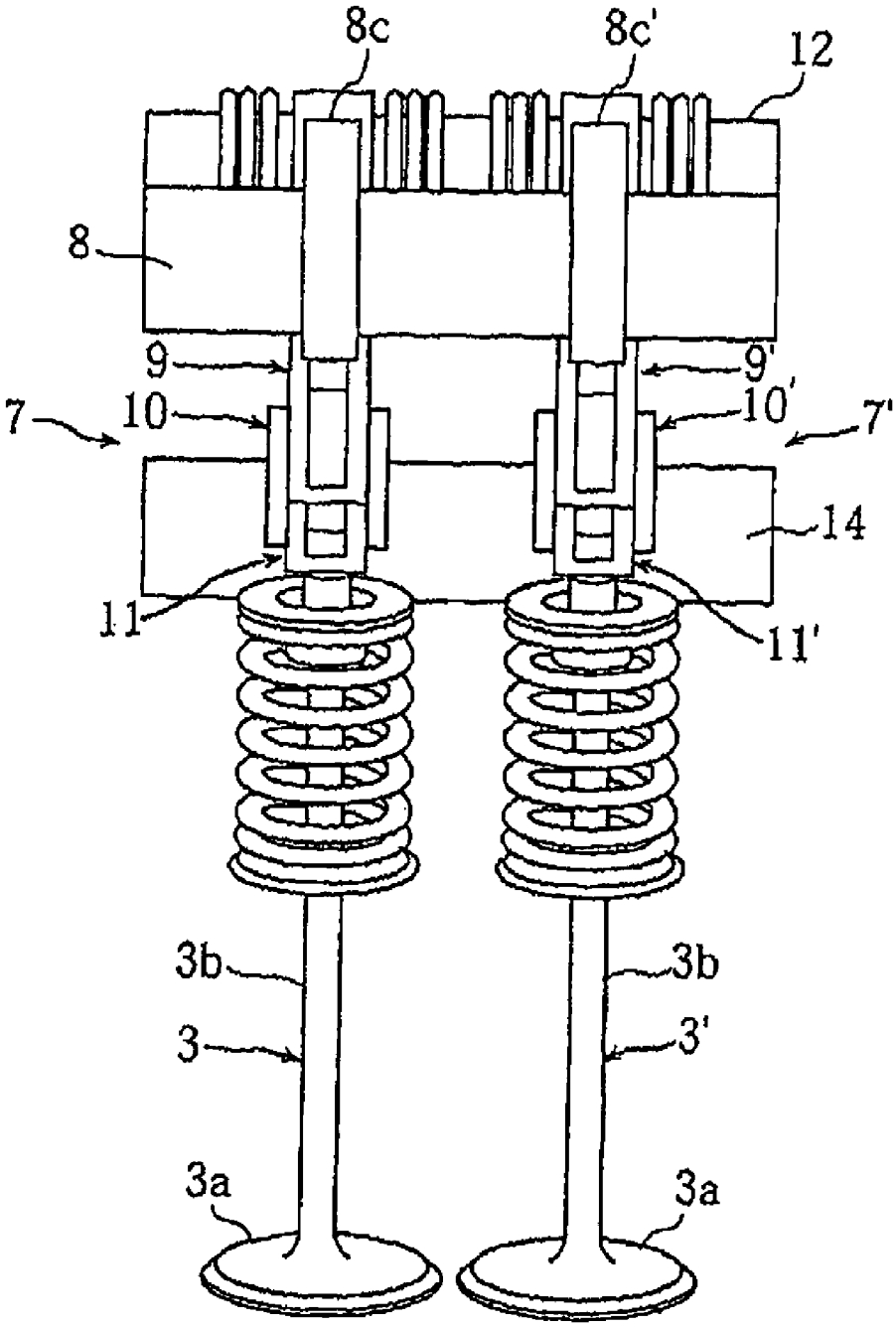
FIG. 11 is a front view of the device of the above fourth embodiment in a second position.

FIGS. 10 and 11 are explanatory drawings of a fourth embodiment of the present invention, in which similar parts are denoted by the same reference numerals as in FIGS. 1 and 2.

The fourth embodiment is an example in which separate valve train devices 7, 7' are disposed for left and right intake valves 3, 3', respectively. More specifically, the valve train devices are configured such that: left and right cam noses 8*c*, 8*c'* of the intake camshaft 8 cause left and right swing members 9, 9' to swing. The swing members 9, 9' cause left and right rocker arms 11, 11' to swing through left and right intermediate rockers 10, 10', and the swing of the rocker arms 11, 11' causes the intake valves 3, 3' to proceed and retract in the axial direction, and thus intake valve openings 2*b*, 2*b'* are opened and closed.

In the fourth embodiment, the separate left and right valve train devices 7, 7' are disposed. Therefore, appropriately changing the features of the left and right cam noses 8*c*, 8*c'*, left and right swing cam surfaces 9*b*, 9*b'*, and the left and right intermediate rockers 10, 10' allows for operating the left and right intake valves 3, 3' at different timings and/or at different amounts of valve lift. In a modified embodiment, the left and right intake valves 3'3' may be provided with the same timings and/or the same amounts of valve lift.

Figure 12:
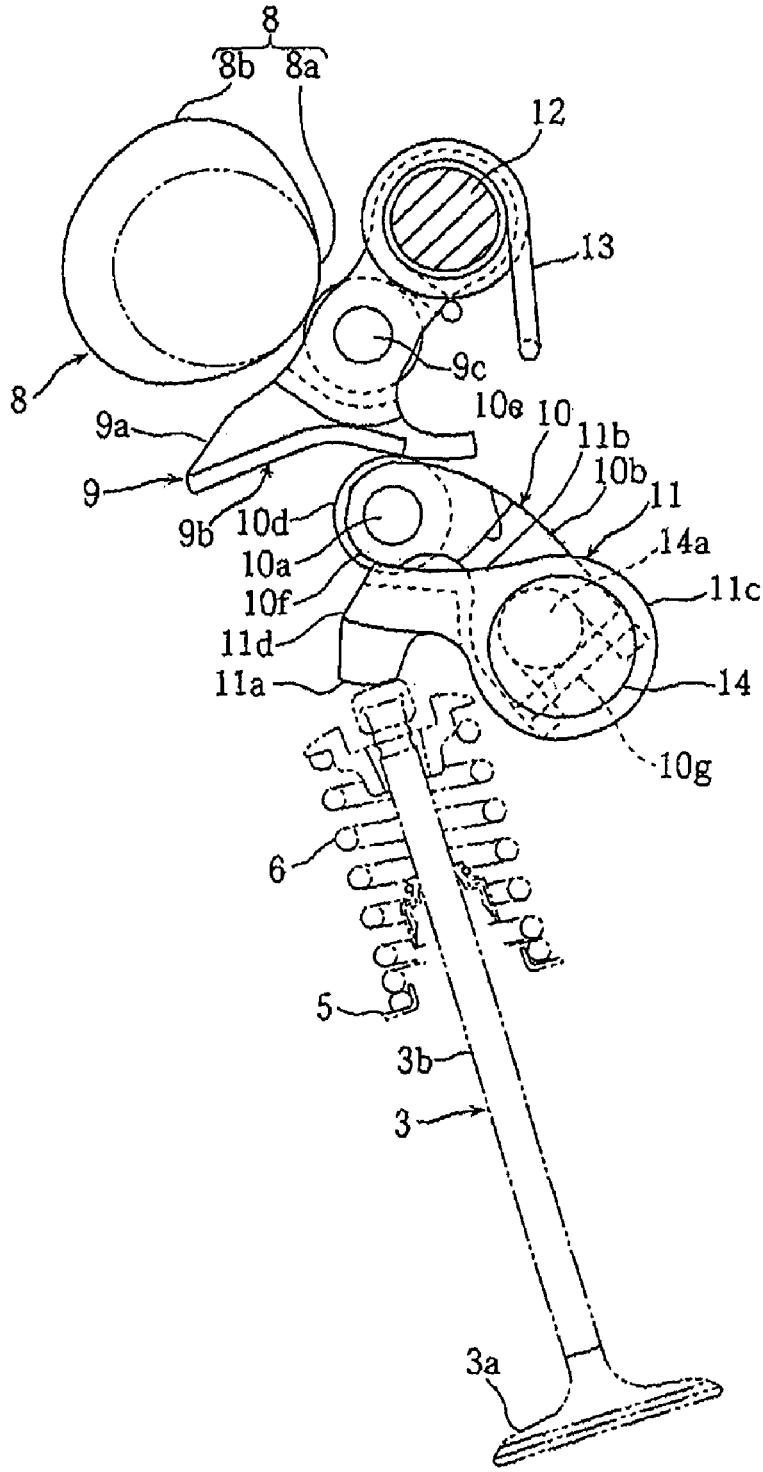
FIG. 12 is a sectional side view of a device according to a fifth embodiment of the present invention.

FIG. 12 is an explanatory drawing of a fifth embodiment of the present invention, in which similar parts are denoted by the same reference numerals as in FIGS. 9 and 10. The fifth embodiment is an example in which the intermediate rocker roller 10*d* is depressed by the swing cam surface 9*b* of the swing member 9. A projecting depressing portion 10*e* is formed on the intermediate arm portion 10*b* at the side end to vertically overlap with the rocker arm 11, and the pressurized rocker face 11*b* of the rocker arm 11 is depressed by a depressing surface 10*f* formed on the lower end surface of the depressing portion 10*e*.

Incidentally, in this embodiment, the intermediate rocker 10 is connected to the rocker shaft 14 to be rotationally movable in a way such that the intermediate arm portion 10*b* of the intermediate rocker 10 is formed in a split manner at its rear end and attached to the eccentric pin portion 14*a*, and a retaining pin 10*g* is inserted in split sections to interpose the eccentric pin portion 14*a*.

In such a manner as described, the rocker arm 11 is depressed not directly by the intermediate rocker pin 10*a* but by the depressing surface 10*f* of a large radius of curvature formed on the intermediate rocker 10. This can reduce contact stress to the pressurized rocker face and reduce the number of parts used.

Incidentally, in the foregoing embodiments, description has been made of the case in which the swing member 9 is supported on the swing shaft 12. The swing member 9, however, may be alternatively supported on a spherical pivot.

Description has also been made of the case in which the driving means for swinging the swing member 9 is the camshaft 8 or 18. The driving means, however, is not limited to the camshaft 8 but can be of a solenoid type, a cylinder type, or any other type that can swingably drive the swing member 9 at a speed in accordance with engine speed.

According to one embodiment of the invention, when the swing member 9 is swung by the driving means, the swing cam surface 9*b* of the swing member swingably drives the rocker arm 11 through the intermediate rocker member 10, and the rocker arm 11 drives the valve to open and close. When the intermediate rocker moving mechanism causes the rocker shaft 14 to rotationally move, the contact points of the intermediate rocker member 10 with the swing cam surface 9*b* and the pressurized rocker face 11*b* continuously move, so that the valve opening duration and the maximum amount of lift can be continuously controlled.

The rotational movement of the rocker shaft 14 is thus used to move the intermediate rocker member 10. This provides a very simple structure and results in increase in accuracy of the control of the valve opening duration and the maximum amount of lift.

According to an embodiment of the invention, the intermediate rocker roller 10*d* and the intermediate rocker pin 10*a* are arranged in the intermediate rocker member 10 at the front end, and the rear end of the intermediate rocker member 10 is swingably connected to the eccentric pin portion 14*a* formed in the midsection of the rocker shaft 14. Therefore, when the rocker shaft 14 is rotationally moved, the intermediate rocker roller 10*d* and the intermediate rocker pin 10*a* continuously move along the swing cam surface 9*b* and the pressurized rocker face 11*b*, respectively, so that the valve opening duration and the amount of valve lift can continuously change with a very simple structure.

Further, the rocker shaft 14 as the center of swing of the rocker arm 11, and the eccentric pin portion 14*a* as the center of swing of the intermediate rocker member 10 are positioned adjacent to each other. This can significantly reduce the sliding amount of the intermediate rocker pin or the intermediate arm portion of the intermediate rocker member 10 on the pressurized rocker face 11*b* of the rocker arm in connection with the opening and closing of the valve.

According to an embodiment of the invention, the rotation of the camshaft 8 causes the swing member to swing the rocker arm through the intermediate rocker member 10, so that the valve is driven to open and close. As the intermediate rocker member 10 is moved toward the rocker shaft 14, the valve opening duration and the maximum amount of valve lift decrease, and as the intermediate rocker member 10 is moved opposite the rocker shaft 14, the valve opening duration and the maximum amount of valve lift increase.

In an operating condition in which the valve opening duration is long and the maximum amount of valve lift is large, the intermediate rocker roller 10*d* and the intermediate rocker pin 10*a* of the intermediate rocker member 10 are moved opposite the rocker shaft 14. Thus, the rocker lever ratio (=Lv/Lc, where Lc is the distance from the center of swing of the rocker arm to the straight line which connects the intermediate rocker roller and the center of swing of the swing member, and Lv is the distance from the center of swing of the rocker arm to the valve stem) decreases, and the valve is depressed generally at the immediate top. Therefore, the rigidity of the overall valve open/close mechanism increases.

Meanwhile, in an operating condition in which the valve opening duration is short and the maximum amount of valve lift is small, the intermediate rocker roller 10*d* and the intermediate rocker pin are moved toward the rocker shaft. Thus, the rocker lever ratio (=Lv/Lc) increases, and the maximum amount of valve lift is easily obtained independently of the short valve opening duration. This can effect reduction of pumping loss as well as improvement of combustion, prevent reduction in ramp speed, and improve controllability of valve open/close timing.

According to another embodiment of the invention, the rotation of the camshaft 8 causes the swing member 9 to swing the rocker arm through the intermediate rocker member 10, so that the valve is driven to open and close. As the intermediate rocker member 10 is moved opposite the rocker shaft 14, the valve opening duration and the maximum amount of valve lift decrease, and as the intermediate rocker member 10 is moved toward the rocker shaft 14, the valve opening duration and the maximum amount of valve lift increase.

In an operating condition in which the valve opening duration is short and the maximum amount of valve lift is small, the intermediate rocker roller 10*d* and the intermediate rocker pin 10*a* of the intermediate rocker member 10 are moved opposite the rocker shaft 14. Thus, the rocker lever ratio (=Lv/Lc) decreases, and the valve is depressed generally at the immediate top, and the rigidity of the overall valve open/close mechanism increases.

Meanwhile, in an operating condition in which the valve opening duration is long and the maximum amount of valve lift is large, the intermediate rocker roller 10*d* and the intermediate rocker pin 10*a* are moved toward the rocker shaft 14. Thus, the rocker lever ratio (=Lv/Lc) increases, and the optimum amount of lift is easily obtained.

According to yet another embodiment of the invention, the swing roller to be depressed by the camshaft is provided in the space enclosed by straight lines which connect the center of swing of the swing member and the ends of the swing cam surface, and the swing cam surface. This can decrease the bending moment produced by the rotational force of the camshaft which works on a support portion of the swing roller, resulting in increase of rigidity of the swing member.

According to an embodiment of the invention, the balance spring 13 is provided for rotatably urging the swing member 9 in the direction that restricts the weight of the swing member 9 from working on the valve spring 6 which urges the valve in a closed state. Therefore, disposing the swing member 9 does not increase load on the valve spring 6. Thus, there is no need to increase the spring load of the valve spring 6, thereby providing optimum follow-up characteristics of the valve at high rpm, while preventing increase in loss of horsepower caused by the valve spring 6.

According to an embodiment of the invention, the camshaft 8 is of a crankshaft type having the cam plate 19*b*, and the cam plate and the swing member are connected together by the connecting rod 20. Therefore, the swing member can be driven to swing easily and reliably and provide good follow-up characteristics, and the control accuracy of the valve opening and the amount of valve lift can be improved.

Although the foregoing systems and methods have been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. While certain embodiments of the inventions have been described, these embodiments have been presented by way of example only, and are not intended to limit the scope of the inventions. Indeed, the novel methods and systems described herein may be embodied in a variety of other forms without departing from the spirit thereof.

What is claimed is:

1. A valve train device for an engine adapted to pivot a rocker arm supported on a rocker arm support shaft to drive a valve which opens and closes a valve opening formed in a combustion chamber, the device comprising a valve drive device, a swing member pivotally supported on a swing member support shaft and driven to pivot about the swing member support shaft by the valve drive device, an intermediate rocker member pivotally supported on the rocker arm support shaft, the intermediate rocker member being provided between a swing cam surface formed on the swing member and a rocker face formed on the rocker arm, for transmitting the movement of the swing cam surface generated by the valve drive device to the rocker face, and an intermediate rocker moving mechanism configured to rotate the rocker arm support shaft and thereby move a first contact point between the intermediate rocker member and the swing cam surface and a second contact point between the intermediate rocker member and the rocker face to continuously vary at least one of the valve opening duration and the amount of valve lift.

2. The valve train device according to claim 1, wherein the intermediate rocker member has intermediate rocker arm portion and an intermediate rocker roller provided at the front end of an intermediate arm portion through an intermediate rocker pin, wherein the intermediate rocker roller is depressed by the swing cam surface, and the intermediate rocker pin depresses the rocker face.

3. The valve train device of claim 2, wherein the intermediate rocker moving mechanism comprises an eccentric pin portion on the rocker arm support shaft, the eccentric pin portion being decentered from the rocker arm support shaft and being pivotally connected to a rear end of the intermediate arm portion.

4. The valve train device according to claim 2, wherein the drive device is a camshaft disposed generally opposite the rocker arm support shaft with respect to the swing member.

5. The valve train device according to claim 4, wherein the swing cam surface is comprises a base circle portion and a lift portion connected together, the base circle portion configured not to change the amount of valve lift when the swing member changes in swing angle, and the lift portion being configured to increase the amount of valve lift with the increase of the swing angle of the swing member, wherein the base circle portion is disposed to be positioned closer to the rocker arm support shaft as compared to the lift portion, and wherein at least one of the valve opening duration and the maximum amount of valve lift decrease as the intermediate rocker roller and the intermediate rocker pin are moved toward the rocker arm support shaft, while at least one of the valve opening duration and the amount of valve lift increase as the intermediate rocker roller and the intermediate rocker pin are moved away from the rocker arm support shaft.

6. The valve train device for an engine according to claim 2, wherein the rotating valve drive device is a camshaft disposed on the same side as the rocker arm support shaft with respect to the swing member, wherein the swing cam surface comprises a base circle portion and a lift portion connected together, the base circle portion configured not to change the amount of valve lift when the swing member changes in swing angle, and the lift portion configured to increase the amount of valve lift with the increase of the swing angle of the swing member, wherein the lift portion is disposed to be positioned closer to the rocker arm support shaft as compared to the base circle portion, and wherein at least one of the valve opening duration and the maximum amount of valve lift decrease as the intermediate rocker roller and the intermediate rocker pin are moved away the rocker arm support shaft, while at least one of the valve opening duration and the maximum amount of valve lift increase as the intermediate rocker roller and the intermediate rocker pin are moved toward the rocker arm support shaft.

7. The valve train device according to claim 1, wherein the swing member includes a roller that is depressed by the valve drive device, the roller being provided in a space enclosed by a pair of straight lines which connect the center of the swing member support shaft and the ends of the swing cam surface.

8. The valve train device according to claim 1, comprising a balance spring configured to urge the swing member in a direction that restricts the weight of the swing member from working on a valve spring configured to urge the valve into a closed state.

9. The valve train device according to claim 1, wherein the rotating drive device comprises a crankshaft-type camshaft that includes a decentered disk-like cam plate that is connected to a rotatable end of a connecting rod, while the other end of the connecting rod is rotatably connected to the swing member.

10. The valve train device according to claim 1, wherein the drive device is a camshaft.

11. A method of continuously adjusting at least one of maximum valve lift and valve timing of a valve of an internal combustion engine, the method comprising:

rotating a valve drive device;

transferring the rotational movement of the valve drive device a swing member that is pivotally supported on a swing member support shaft;

transferring pivoting movement of the swing member through a first contact point to an intermediate member that is pivotally supported on a rocker arm support shaft;

transferring pivoting movement of the intermediate member through a second contact point to a rocker arm that is pivotally supported on the rocker arm support shaft and is configured to open and close the valve; and changing the orientation of the first and second contact points with respect to the rocker shaft so as to change at least one of the valve duration and the maximum valve lift.

12. The method of claim 11, wherein changing the orientation of the first and second contact points with respect to the rocker shaft comprises changing both the valve duration and the maximum valve lift.

13. The method of claim 11, wherein changing the orientation of the first and second contact points with respect to the rocker shaft comprising moving the first contact point away from the rocker arm support shaft.

14. The method of claim 11, wherein moving the first contact point away from the rocker arm support shaft increases at least one of the valve duration and the maximum valve lift.

15. The method of claim 11, wherein moving the first contact point towards the rocker arm support shaft decreases at least one of the valve duration and the maximum valve lift.

16. The method of claim 11, wherein rotating the valve drive device comprises rotating a camshaft.

17. The method of claim 11, changing the orientation of the first and second contact points with respect to the rocker shaft comprises rotating an eccentric portion of the rocker arm shaft.

* * * * *